US007552505B2

(12) United States Patent
Eberl

(10) Patent No.: US 7,552,505 B2
(45) Date of Patent: Jun. 30, 2009

(54) CLEANING SYSTEM FOR CLEANING THE OUTER SKIN OF AIRCRAFT

(76) Inventor: Jan Dieter Eberl, Am Sandügel 2, A-6370 Kitzbühel (AT)

( * ) Notice: Subject to any disclaimer, the term of this patent is extended or adjusted under 35 U.S.C. 154(b) by 399 days.

(21) Appl. No.: 10/554,169

(22) PCT Filed: Apr. 23, 2004

(86) PCT No.: PCT/AT2004/000137

§ 371 (c)(1),
(2), (4) Date: Sep. 19, 2006

(87) PCT Pub. No.: WO2004/094078

PCT Pub. Date: Nov. 4, 2004

(65) Prior Publication Data

US 2007/0119005 A1 May 31, 2007

(30) Foreign Application Priority Data

Apr. 23, 2003 (AT) ..... A 619/2003

(51) Int. Cl.
*B08B 1/04* (2006.01)

(52) U.S. Cl. ..... 15/321; 15/322; 15/383

(58) Field of Classification Search ..... 15/321, 15/322, 383, 392; *B08B 1/04, 3/04*
See application file for complete search history.

(56) References Cited

FOREIGN PATENT DOCUMENTS

| | | |
|---|---|---|
| DE | 100 06 481 | 4/2001 |
| EP | 1 238 905 | 9/2002 |

*Primary Examiner*—David A Redding
(74) *Attorney, Agent, or Firm*—Andrew Wilford

(57) ABSTRACT

A cleaning system for cleaning the outer skin of aircraft of all types is provided with a cleaning head (1). This cleaning head (1) is fastened to an arm, which is mounted on a system support, for example, on a low-bed truck. The cleaning head (1) is provided with one or more rollers (2, 7, 13), whereby openings (5, 9, 11) are provided in hollow shafts (3, 8, 12). A cleaning medium, steam and polishing agent can be introduced via said openings, and the waste water contaminated with the dirt particles that are removed from the outer skin of the aircraft can be suctioned off also via said openings.

8 Claims, 2 Drawing Sheets

CLEANING SYSTEM FOR CLEANING THE OUTER SKIN OF AIRCRAFT

CROSS REFERENCE TO RELATED APPLICATIONS

This application is the US national phase of PCT application PCT/AT2004/000137, filed 23 Apr. 2004, published 04 Nov. 2004 as WO2004/094078, and claiming the priority of Austrian patent application A619/03 itself filed 23 Apr. 2003, whose entire disclosures are herewith incorporated by reference.

FIELD OF THE INVENTION

The invention relates to a system for cleaning the skin of aircraft of all types, in particular comprising a scrub head that is carried on a support, for example an arm of a truck-type fork lift.

BACKGROUND OF THE INVENTION

For technical reasons and to meet statutory requirements, passenger aircraft must be cleaned at regular intervals. At present passenger aircraft used for short hops are cleaned every 45 days and for long trips every 90 days.

A particular disadvantage of the standard cleaning method is that both the cleaning agent and liquid (dirty water) fall to the ground and have to be collected so that the mixture of liquid, cleaning agent, and dirt can be dealt with.

OBJECT OF THE INVENTION

It is therefore an object of the invention to provide a cleaning system that can wash, polish, and dry aircraft of any size and type without leaving cleaning agent, liquid, and the like on the ground. A further object of the invention is to provide a cleaning system that reduces the operating costs standard to date and thus reduces the cleaning costs.

To reduce costs it would be desirable if the aircraft to be cleaned could be cleaned directly on the ramp or anywhere else, without having to move it into a hangar.

SUMMARY OF THE INVENTION

These objects are attained in that the cleaning system has a scrub head that has at least one roller, outlets for at least one cleaning agent, inlets constituting part of an aspirating means for drawing in the cleaning agent, and outlets for steam, a polishing agent, or the like.

To best achieve the set goal, it is preferable when there are three rollers provided with bristles, blades, or the like and the rollers are carried on respective (hollow) shafts.

In order to supply the cleaning liquid necessary for scrubbing, it is preferable that the shaft carrying the cleaning roller is provided with the outlets through which the cleaning fluid is pumped.

To suction off the supplied cleaning liquid and dissolved dirt, it is preferable that the shaft carrying the aspirating roller is formed with transverse slots through which the cleaning fluid and dirt are suctioned; in this manner it is possible to suction off the cleaning liquid and dirt.

A particular advantage of the apparatus according to the invention is that the shaft carrying the polishing roller has outlets through which a polishing agent and/or steam are pumped.

To rotate the shaft(s), vanes are mounted and an air stream is directed against them to rotate the shaft(s).

BRIEF DESCRIPTION OF THE DRAWING

In the following the invention is more closely described with reference to an embodiment shown in the drawing, without being limited to this embodiment. Therein.

SPECIFIC DESCRIPTION

Figure 1:
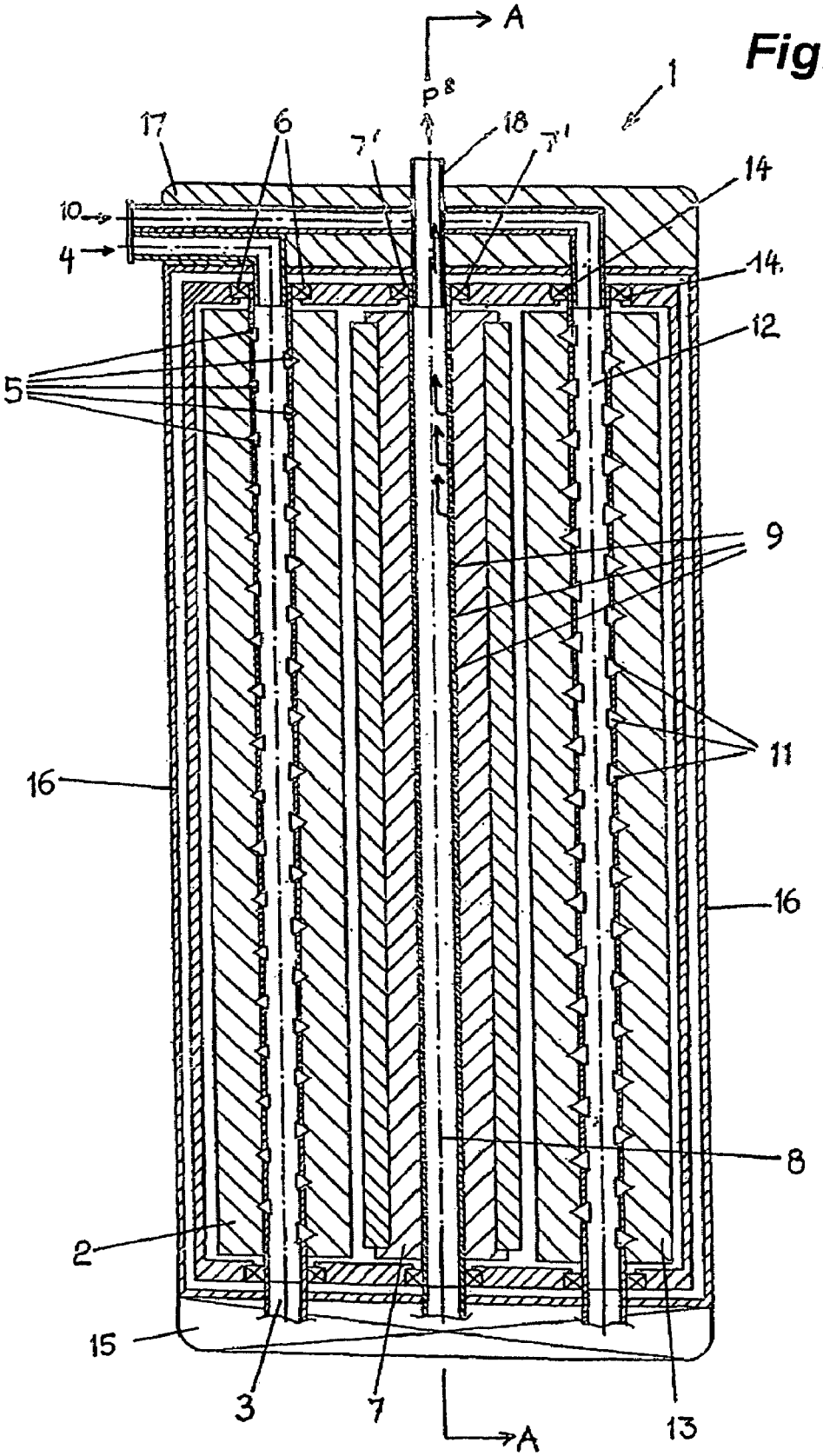
FIG. 1 is a bottom view of the scrubbing heat according to the invention.

According to FIG. 1 a scrubbing head 1 has three rollers 2, 7, and 13.

The scrubbing roller 2 is provided with bristles and is carried on a hollow shaft 3.

A cleaning liquid (mixture of water and cleaning agent) is fed in through an inlet 4 into the hollow shaft 3 and thus enters the scrubbing head 1. The cleaning fluid exits the hollow shaft 3 through the nozzles 5.

The rotating bristles of the scrubbing roller 2 spread the cleaning fluid exiting from the outlets 5 in the scrubbing head 1 on the aircraft surface; this cleaning fluid loosens the dirt on the aircraft surface.

The scrubbing roller 2 is mounted in a bearing 6.

Like the roller 2, there is an aspirating roller 7 mounted on a hollow shaft 8. This hollow shaft 8 is mounted in a bearing 7'.

The aspirating roller 7 is provided with axially extending plastic blades 7" (FIG. 2); these blades 7" move the particle solution on the outer skin of the aircraft being cleaned.

The hollow shaft 8 is formed with transverse slots 9. The dirty water and the particles freed from the aircraft are sucked in through these slots 9; the dirty water and the particles move through the slots 9 into the hollow shaft 8 and are sucked in the direction of arrow $P^8$ along the hollow shaft 8.

Steam and/or a polishing agent are fed in through an intake 10 into the scrubbing head 1. The steam or polishing agent exits through outlets 11 of a hollow shaft 12. This shaft 12 carries a polishing roller 13. The roller 13 is mounted on bearings 14.

The hollow shafts 3, 8, and 12 carry as is standard vanes (not illustrated) so that they can be rotated by a stream of air directed at these vanes.

Another embodiment is possible where an electric motor in a drive 15 rotates the hollow shafts 3, 8, and 12. A transmission is provided between the electric motor constituting a drive means and the hollow shafts 3, 8, and 12.

The hollow shafts 3, 8, and 12 are rotated at different speeds and run in opposite directions. The entire assembly of the scrubbing head 1 with the rollers 2, 7, and 13 on their shafts 3, 8, and 12 is surrounded by a housing 16, with the blades 7" projecting past the housing 16 as shown in FIG. 2 like the unillustrated bristles of the roller 2.

Outside the housing 16 there is a connector block 17 to which are made the connections with the cleaning-fluid input 4, the input 10 for polishing agent and steam, and an outlet 18 through which dirty water and particles are sucked.

Figure 2:
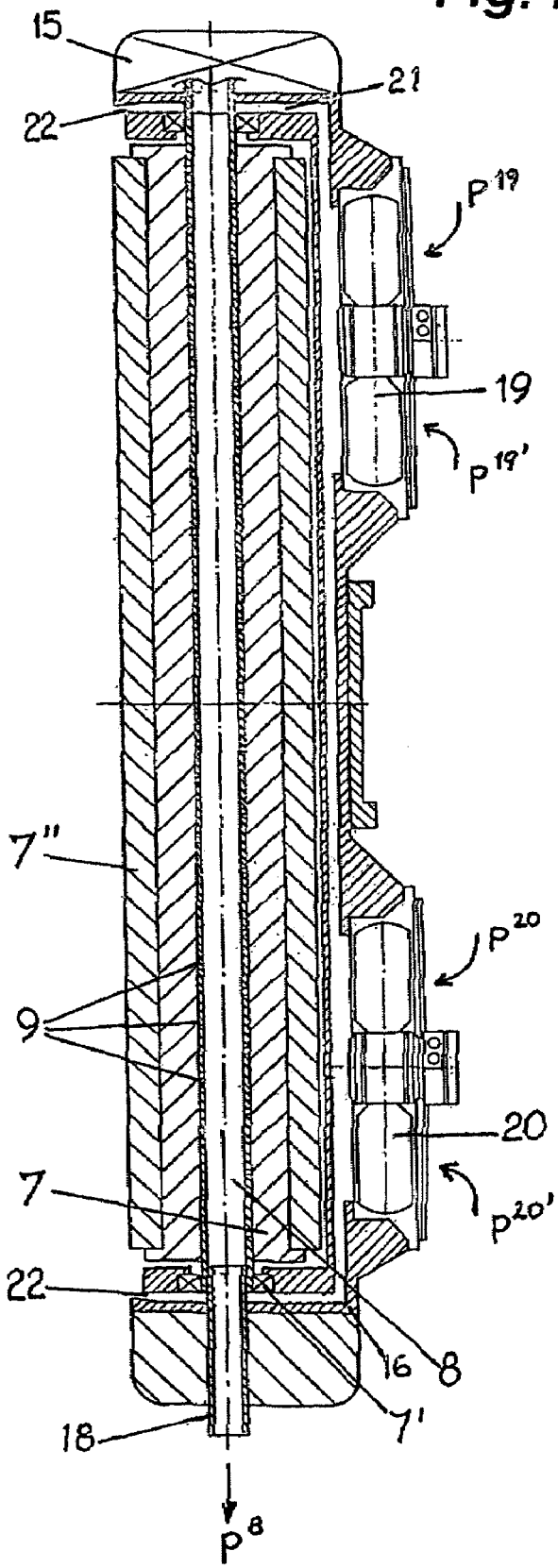
FIG. 2 is a longitudinal section (A-A) through the device in accordance with the invention.

FIG. 2 shows how the aspirating roller 7 is mounted inside the housing 16. The aspirating roller 7 is mounted on the hollow shaft 8 that has the transverse slots 9. The hollow shaft 8 is journaled in bearings 7'.

On the upper side of the scrubbing head 1 are fan/motor units 19 and 20 (see FIG. 2). An air passage 21 extends inside and around the housing 16. In order to increase the air-travel speed, the housing inner walls converge generally conically. In order to further increase the speed of the air current, the flow passage 21 is shaped like a nozzle 22 at its outlet. Air is sucked in as shown by $P^{19}$, $P^{19'}$, $P^{20}$, and $P^{20'}$, moves along the passage 21 and is expelled at the outlet 22. The annular exiting air stream seals the housing to the aircraft hull.

Further modifications are possible according to the invention, for example fewer or more rollers could take over the functions of cleaning and polishing. In addition the locations of the various inputs and outputs for the cleaning agents and dirty water could be moved. As already stated, the way the rollers are driven can be changed, by an electric or pneumatic motor and a transmission.

The invention claimed is:

1. An aircraft-scrubbing apparatus comprising:

a housing having an open side engageable against a dirty surface to be cleaned;

a hollow scrubbing shaft journaled in the housing, rotatable about a respective axis, and formed with a plurality of radially directed openings;

a hollow aspirating shaft journaled in the housing, rotatable about a respective axis, and formed with a plurality of radially directed openings;

means for pumping a cleaning liquid and cleaning agent under pressure into the scrubbing shaft and thereby expelling the liquid and cleaning agent radially from the scrubbing shaft, whereby the liquid and cleaning agent expelled radially from the scrubbing shaft dissolve dirt on the surface;

means for aspirating the cleaning liquid and agent and any dirt dissolved therein through the openings of the aspirating shaft;

brushes on the shafts exposed at the housing open side; and drive means in the housing for rotating the shafts about the respective axes and thereby moving the brushes against the surface.

2. The aircraft-scrubbing apparatus defined in claim 1 wherein each brush has radially extending elements projecting past the open side of the housing.

3. The aircraft-scrubbing apparatus defined in claim 2 wherein the radially extending elements of the scrubbing shaft are bristles.

4. The aircraft-scrubbing apparatus defined in claim 2 wherein the radially extending elements of the aspirating shaft are flexible and axially extending blades.

5. The aircraft-scrubbing apparatus defined in claim 1, further comprising:

a hollow polishing shaft journaled in the housing, rotatable about a respective axis, and formed with a plurality of radially directed openings;

means for pumping a polishing agent or steam under pressure into the polishing shaft and thereby expelling the agent or steam radially from the polishing shaft;

a brush on the polishing shaft exposed at the housing open side; and drive means in the housing for rotating the polishing shaft about the respective axes and thereby moving the respective brush against the surface.

6. The aircraft-scrubbing apparatus defined in claim 5 wherein all of the axes are generally parallel.

7. The aircraft-scrubbing apparatus defined in claim 5 wherein the aspirating shaft is between the polishing and scrubbing shafts.

8. The aircraft-scrubbing apparatus defined in claim 1 wherein the housing forms an annular outlet surrounding the open side and directed away from the housing, the apparatus further comprising means for supplying air under pressure to the annular outlet and thereby directing an annular air get against the aircraft surface around the brushes.

* * * * *